United States Patent [19]

Camara

[11] 4,108,431

[45] Aug. 22, 1978

[54] GAME APPARATUS

[76] Inventor: Manuel Camara, 600 Jennings Ave., Vallejo, Calif. 94590

[21] Appl. No.: 822,895

[22] Filed: Aug. 8, 1977

[51] Int. Cl.[2] ..... A63F 9/00

[52] U.S. Cl. ..... 273/1 R; 273/145 D

[58] Field of Search ..... 273/1 R, 1 E, 1 M, 145

[56] References Cited

U.S. PATENT DOCUMENTS

| | | | |
|---|---|---|---|
| 187,686 | 2/1877 | Wedesweiler | 273/145 D |
| 455,390 | 7/1891 | Drummer | 273/145 D |
| 3,532,343 | 10/1970 | Eggers | 273/1 R X |

*Primary Examiner*—Paul E. Shapiro

*Attorney, Agent, or Firm*—Naylor, Neal & Uilkema

[57] ABSTRACT

Game apparatus is provided with a transparent cylinder containing a dice support platform. The platform is movable by a manually operable lever to toss the dice. At the top of the cylinder there is removably mounted a slot-fed coin or chip container which is secured in a closed, locked condition by each of a multiple of key-operated locks. Removably fitted into the cylinder so as to be accessible to the players is a number of keys, two or so, for each of the key-operated locks, to be selectively tried by preliminary winners to determine the final winner, the one who opens the last of the key-operated locks.

3 Claims, 3 Drawing Figures

GAME APPARATUS

SUMMARY OF THE INVENTION

The essential object of the invention is to provide a new and different game apparatus to be employed in a game of chance along with paraphernalia of playing cards, dice and chips or coins.

Other objects and advantages of the invention will be apparent from the following description taken in conjunction with the drawing forming part of this specification, and in which.

Figure 1:
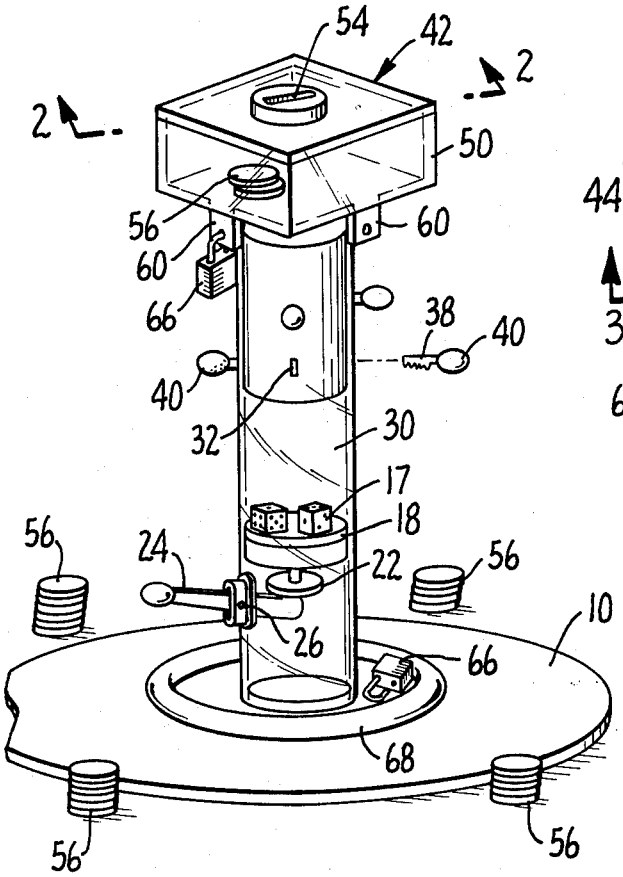
FIG. 1 is a view in perspective of the game apparatus of the invention.
Figure 2:
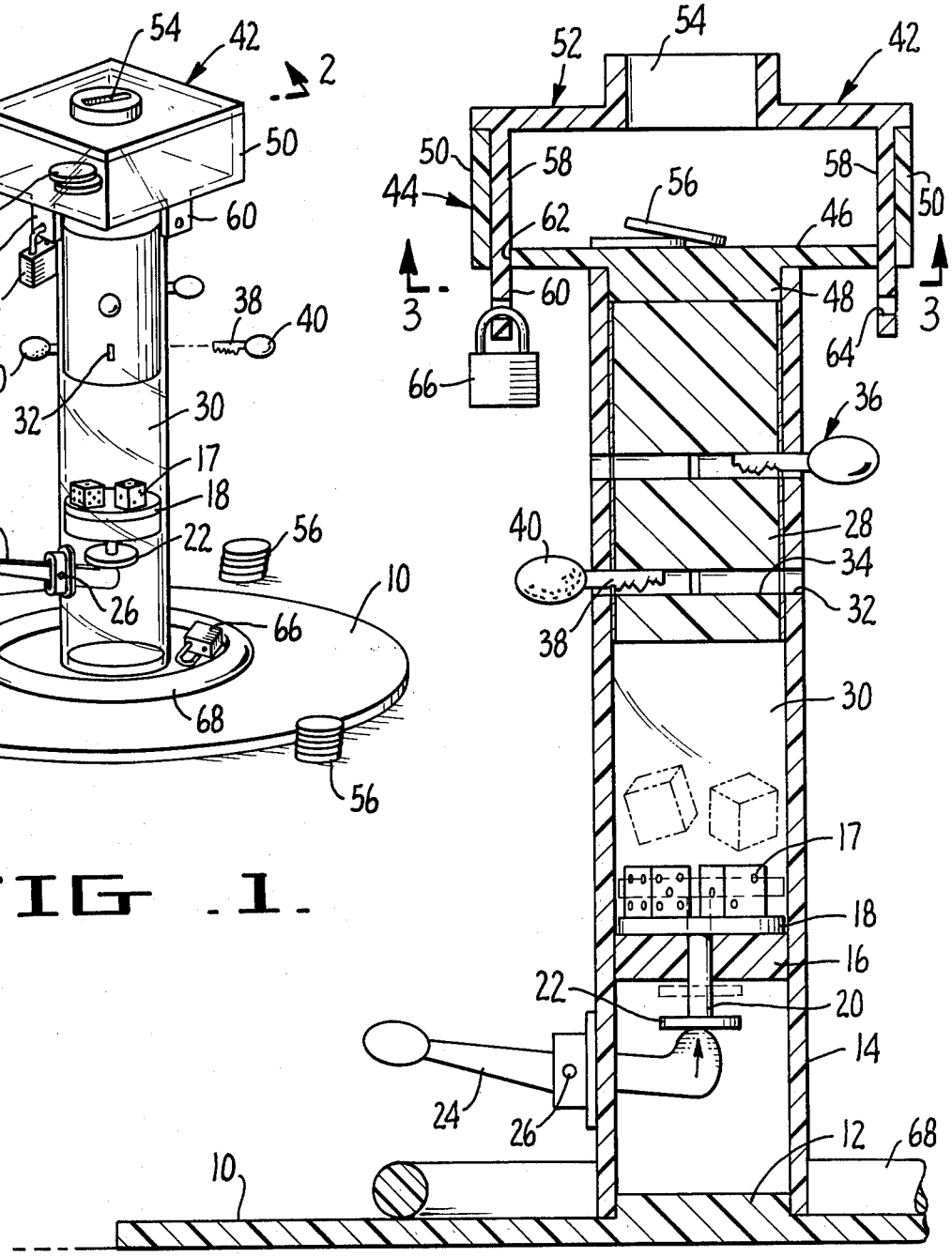
FIG. 2 is an enlarged view taken along lines 2—2 of FIG. 1.
Figure 3:
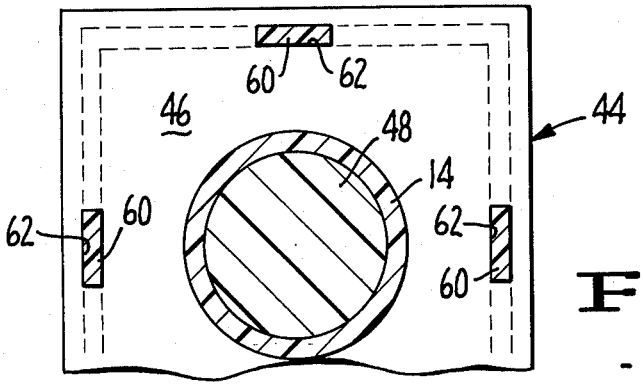
FIG. 3 is a view taken along lines 3—3 of FIG. 2.

With reference to the drawing, the game apparatus of the invention comprises a base 10 having a central mounting hub 12 over which the lower end of cylinder 14 is fitted so as to permit manual rotation of the cylinder about its vertical, longitudinal axis by the players to make various parts of the apparatus more accessible to them where they sit about the table of play.

The cylinder is formed of transparent material. It is provided with a fixed, internal cylindrical plug 16 which supports a cylindrical dice platform 18, the latter being provided with a stem 20 having integral therewith a disc-shaped member 22. The cylinder 14 is provided with a lever 24 which extends into the cylinder to engage the underside of the member 22, 26 being the axis of pivotal attachment of the lever to the cylinder.

The cylinder is provided with a cylindrical plug 28 which is preferably formed of foamed plastic and is frictionally, removably fitted within the upper end of the cylinder. The plug 28 constitutes an upper closure for the dice compartment 30. The plug 28 and cylinder 14 are provided with aligned, radial slots 32 and 34 comprising friction-fit storage passages for removable keys 36, the latter being provided with blade elements 38 and handle elements 40.

Supported for turning movement and for ready removal and replacement is a container or collection box 42 comprising a bottom or tray portion 44 having a bottom wall 46, a cylindrical hub 48 adapted to freely fit within the upper end of the cylinder, and sidewalls 50, and a top or cover portion 52 having a feed slot 54 for coins or chips 56 and having sidewalls 58 terminating in tongue elements 60 which extend through complemental slots 62 formed in the bottom wall 46 of the lower part 44 of the collection box.

The lower, exposed ends of the tongue elements 60 are provided with attachment apertures 40 for locks 66. The preferred number of tongue elements 60 and locks 66 is four and the preferred number of keys 36 is eight, two each for each of the locks 66.

The preferred manner of play with the game apparatus is as follows. The players, preferably four or more, gather around a table on which the apparatus is centrally positioned. The dealer or someone designated by the dealer strikes the lever 24 to toss the dice 17 so that they display a new point total, e.g. a seven. The dealer deals the cards one at a time to the players until someone is dealt a seven, or until a player has been dealt two consecutive cards having a total point count of seven, whereupon the recipient is a preliminary winner of the game being played. The preliminary winner wins the right to select one of the eight keys and try it in one of the four locks. If he succeeds in unlocking the selected lock with the selected key, the removed lock and key are placed on the base between the cylinder 14 and a ring member 68 attached to the base. If his lock opening effort turns out to be unsuccessful, the preliminary winner pays a chip penalty to the collection box 42 and the other players pay chip antes to the box to get set for the next hand of play. The adoption of suitable ante and penalty enforcing procedures ensures that the box will be desirably stocked with chips at the time the ultimate winner of the game successfully opens the last of the four locks, thereby enabling him to remove the cover from the collection box and gain access to his prize, the total number of chips in the box.

It will be understood that the adopted format of play with this game apparatus is more or less a matter of choice with the collective users thereof. However, the procedure above-described for the use of the apparatus has been found to be both popular and calculated to maintain the interest of the players over long periods of play.

The cylinder 14 may be manually rotated by the players to suitably position the dice actuating lever 24 for use by any particular player and to position the keys for selection by any particular player. Also, the collection box may be manually rotated while it is in place at the top of the cylinder in order that a particular player may attempt to operate the lock of his choice with the key of his choice.

What is claimed is:

1. Game apparatus comprising a support base, an upright, tubular carrier member mounted on the base, a platform disposed within said member and means mounting the same therein for two-way vertical movement, a pair of dice supported by said platform, means for impacting said platform to throw the dice thereon, said member having a transparent wall portion for the viewing of said dice, a collection box having a coin-slot entryway for chips and the like removably attached to the upper end of said member, a plurality of key-operated locks removably attached to said box and individually effective in the closed condition to prevent the opening of said box, and keys for said locks.

2. The game apparatus of claim 1, including a plurality of keys for each of said locks, said box being formed of multiple, separatable parts which remain unseparatable as long as one of said locks remains unopened, and slots formed in said member for the insertion thereinto for storage and for the display for selection of said keys.

3. The game apparatus of claim 2, further including a plug fitted within said member above said platform in spaced relation thereto, said plug having a lower end defining the upper end of a dice throwing chamber for said dice, said slots extending through said member into said plug.

* * * * *